US008147271B2

(12) United States Patent
Xie

(10) Patent No.: US 8,147,271 B2
(45) Date of Patent: Apr. 3, 2012

(54) ELECTRONIC CONNECTION DEVICE

(75) Inventor: Bu-Fan Xie, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/878,226

(22) Filed: Sep. 9, 2010

(65) Prior Publication Data

US 2011/0183543 A1 Jul. 28, 2011

(30) Foreign Application Priority Data

Jan. 22, 2010 (CN) ..... 2010 1 0300604

(51) Int. Cl.
*H01R 11/00* (2006.01)

(52) U.S. Cl. ..... 439/502

(58) Field of Classification Search ..... 439/501, 439/502, 131, 172; 206/351, 373; 242/388.1
See application file for complete search history.

(56) References Cited

U.S. PATENT DOCUMENTS

| | | | | |
|---|---|---|---|---|
| 2,143,529 | A * | 1/1939 | White | 206/351 |
| 7,032,854 | B2 * | 4/2006 | Marsden | 242/388.1 |
| 7,341,463 | B2 * | 3/2008 | Lai | 439/131 |
| 7,677,920 | B2 * | 3/2010 | Huang et al. | 439/501 |

* cited by examiner

*Primary Examiner* — Alexander Gilman
(74) *Attorney, Agent, or Firm* — Altis Law Group, Inc.

(57) ABSTRACT

An electronic connection device for electrically connecting two electronic devices to each other includes a connection unit for electrically connecting the two electronic devices to each other and a receiving unit. The connection unit includes a data cable. The receiving unit includes a main body and a sleeve barrel. The sleeve barrel is detachably assembled to the main body and receives the main body therein. The data cable is coiled on the sleeve barrel when the sleeve barrel assembled to the main body and is coiled on the main body when the sleeve barrel is detached.

12 Claims, 5 Drawing Sheets

ELECTRONIC CONNECTION DEVICE

BACKGROUND

1. Technical Field

The present disclosure relates to housings of electronic connection devices, and particularly to a multifunctional electronic connection device.

2. Description of Related Art

Portable electronic devices, such as mobile phones, personal digital assistants (PDA), and laptop computers, are widely used. Data cables are often used as electronic connection devices to connect the portable electronic devices to other electronic devices for transmitting data and electronic signals, or to connect the portable electronic devices to power supplies for recharging. However, when the data cables are frequently used, they are likely to become entangled with other objects or may be knotted, which causes an inconvenience to operations of the portable electronic devices and the data cables.

Therefore, there is room for improvement within the art.

BRIEF DESCRIPTION OF THE DRAWINGS

Many aspects of the present electronic connection device can be better understood with reference to the following drawings. The components in the various drawings are not necessarily drawn to scale, the emphasis instead being placed upon clearly illustrating the principles of the present electronic connection device. Moreover, in the drawings, like reference numerals designate corresponding parts throughout the figures.

DETAILED DESCRIPTION

Figure 1:
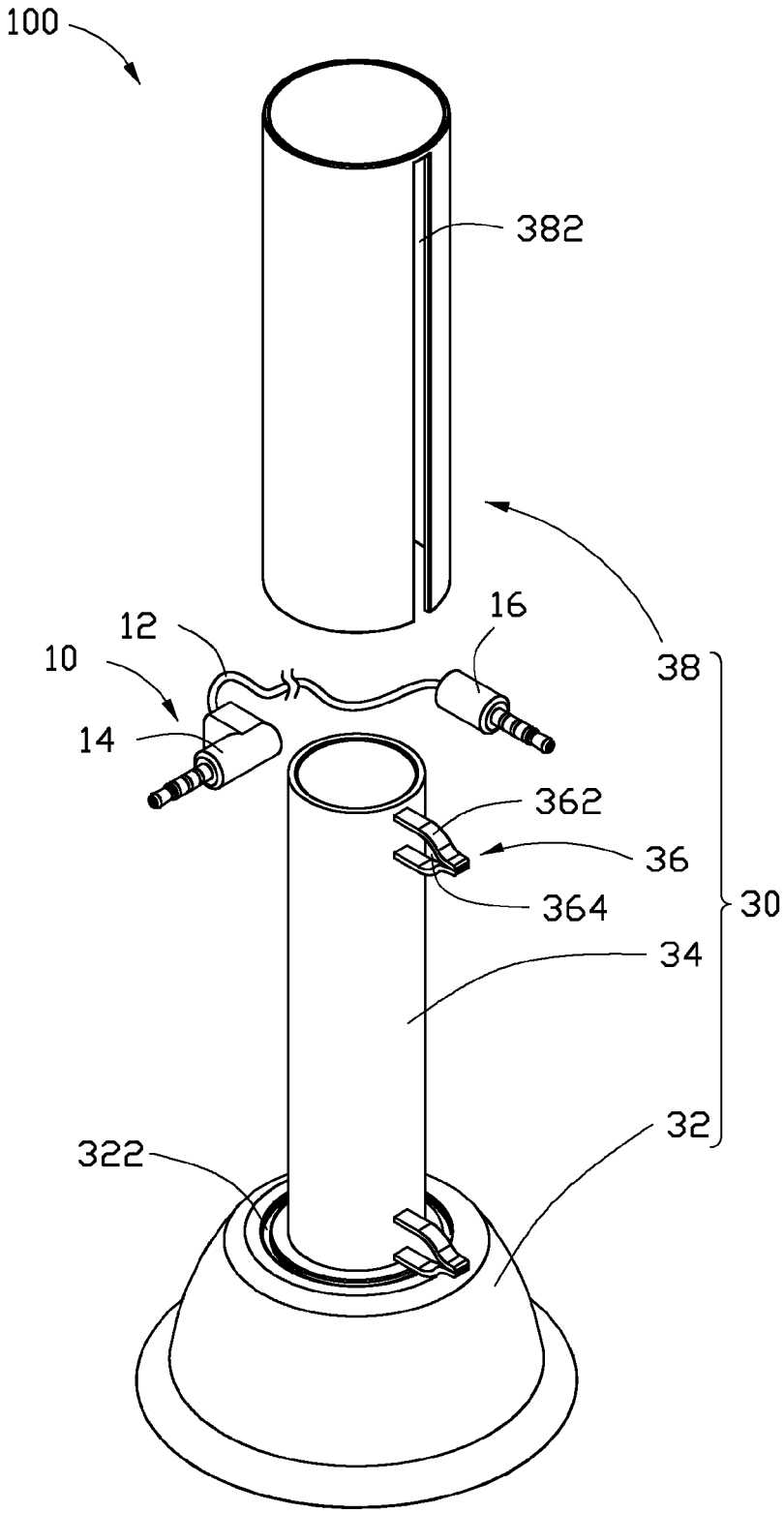
FIG. 1 is a disassembled view of an electronic connection device, according to a first exemplary embodiment.

FIG. 1 shows an electronic connection device 100, according to a first exemplary embodiment. Referring to FIG. 1, the electronic connection device 100 includes a connection unit 10 and a receiving unit 30. The electronic connection device 100 can be used to electrically connect a portable electronic device (not shown), such as a mobile phone, a personal digital assistant (PDA), or a laptop computer, to other electronic devices for transmitting data or electronic signals, or to power supplies for recharging the portable electronic device. The receiving unit 30 is configured to receive the connection unit 10 therein.

In the first exemplary embodiment, the connection unit 10 includes a data cable 12, a first plug 14, and a second plug 16. The first plug 14 and the second plug 16 are both audio plugs and are respectively connected to two ends of the data cable 12. The first plug 14 can be connected to an audio jack of the portable electronic device to receive electronic signals generated by playing audio files, and the second plug 16 can be connected to an audio signal playing device (not shown), such as an earphone, a speaker, etc. In use, the portable electronic device play audio files and generate corresponding electronic signals. The electronic signals are transmitted to the audio signal playing device through the data cable 12 and the second plug 16, and the audio signal playing device converts the electronic signal to audio signals.

The receiving unit 30 includes a base 32, a main body 34, two retaining mechanisms 36, and a sleeve barrel 38. The base 32 is a bowl-shaped shell made of elastic material. When the opening of the base 32 is positioned towards a planar surface (not shown) and the base 32 is pressed towards the surface, the base 32 can be transformed to expel air received therein. Thus, the base 32 is used as a suction cup to be fixed on a planar surface by outside air pressure. A top surface of the base 32 recesses to form a connecting portion 322. The main body 34 is a hollow cylinder and is perpendicularly connected to a bottom of the connecting portion 322.

The retaining mechanisms 36 are respectively mounted on two opposite ends of an outside surface of the main body 34. Each retaining mechanism 36 includes two retaining members 362. The retaining members 362 are planar sheets made of elastic materials, and are perpendicularly connected to the outside surface of the main body 34. In each retaining mechanism 36, the two retaining members 362 thereof are distorted towards each other, such that the distal ends of the two retaining members 362 contact each other, and a retaining space 364 is formed between the two retaining members 362. A width of the retaining space 364 is less than that of the first plug 14 or the second plug 16. Due to elasticity of the retaining members 362, the distal ends of the two retaining members 362 can be separated from each other by force to open the retaining mechanisms 36, and contact each other again to close the retaining mechanisms 36 when the force separating the two retaining members 362 from each other is removed.

The sleeve barrel 38 is a hollow cylinder. A length of the sleeve barrel 38 is greater than or equal to a length of the main body 34 and an inner diameter of the sleeve barrel 38 is larger than an outer diameter of the main body 34, such that the main body 34 can be received in the sleeve barrel 38. The sleeve barrel 38 defines a receiving groove 382 therein. The receiving groove 382 is a straight groove and opens on an end of the sleeve barrel 38. When the main body 34 is inserted into the sleeve barrel 38, the retaining mechanisms 36 can enter the receiving groove 382 through the opening of the receiving groove 382 formed on the end of the sleeve barrel 38, and extend out of the sleeve barrel 38 through the receiving groove 382. The receiving groove 382 can also open on both two opposite ends of the sleeve barrel 38.

Figure 2:
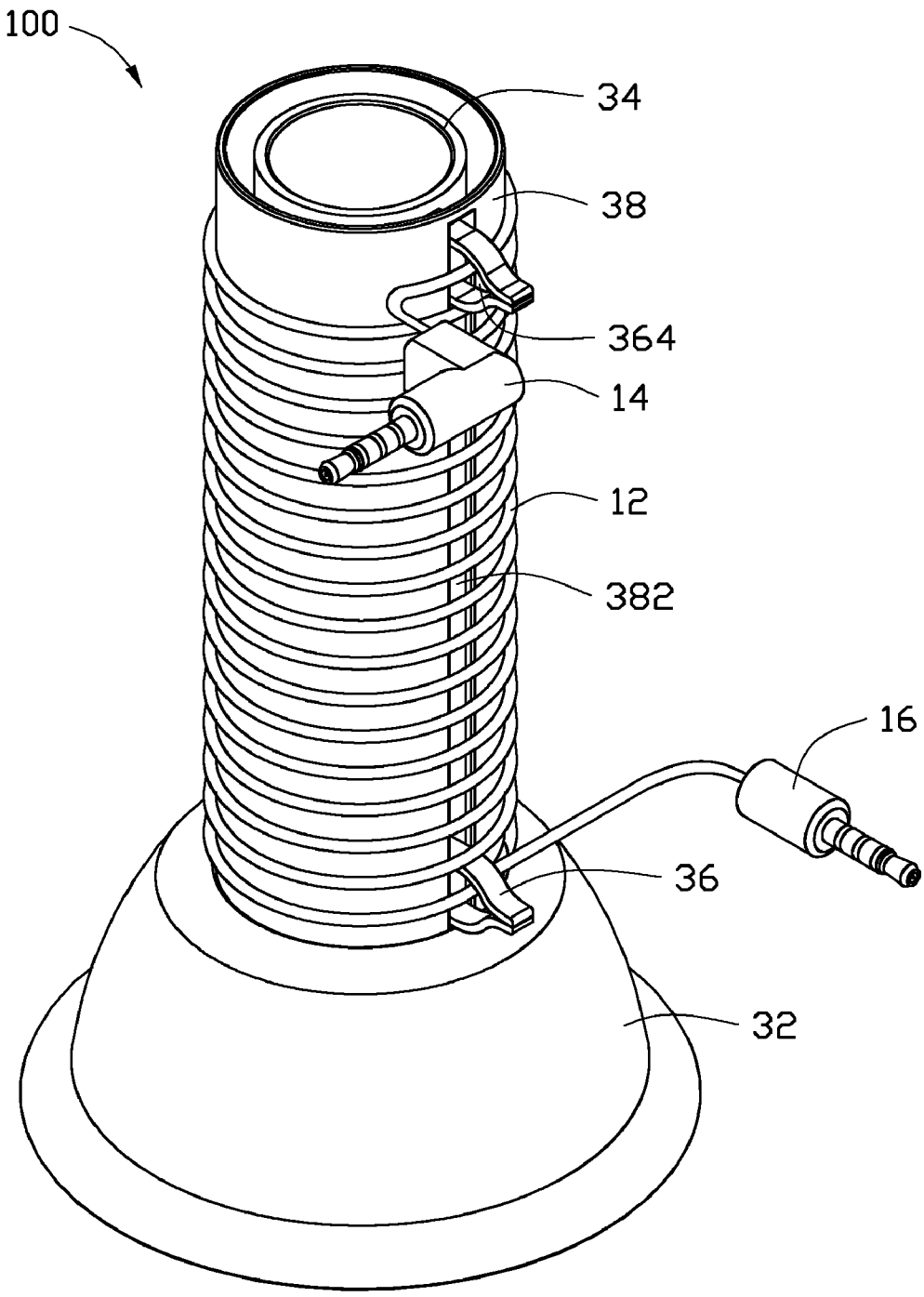
FIG. 2 is an assembled view of the electronic connection device shown in FIG. 1.

Also referring to FIG. 2, in assembly, the main body 34 is aligned with the sleeve barrel 38, and the retaining mechanisms 36 are aligned with the opening of the receiving groove 382 formed on the end of the sleeve barrel 38. Thus, the main body 34 is inserted into the sleeve barrel 38, and the retaining mechanisms 36 are inserted into the receiving groove 382 through the opening of the receiving groove 382 formed on the end of the sleeve barrel 38 and pushed to slide along the receiving groove 382. Until the main body 34 is received in the sleeve barrel 38, the retaining mechanisms 36 extend out of the sleeve barrel 38 through the receiving groove 382.

The data cable 12 is tightly coiled on the sleeve barrel 38. One retaining mechanisms 36 is opened by separating the two retaining members 362 thereof. An end of the data cable 12 positioned adjacent to the first plug 14 is positioned between the two retaining members 362 of the retaining mechanism 36, and the retaining mechanism 36 is then closed again. Thus, the end of the data cable 12 positioned adjacent to the first plug 14 is received in the retaining space 364 of the retaining mechanism 36, and the middle part of the data cable 12 and the first plug 14 are respectively positioned at two sides of the retaining mechanism 36. By similar operations as detailed above, another end of the data cable 12 positioned adjacent to the second plug 16 is received in the retaining space 364 of another retaining mechanism 36, such that the middle part of the data cable 12 and the second plug 16 are respectively positioned at two sides of the another retaining mechanism 36. Since the width of the retaining spaces 364 are less than that of the first plug 14 or the second plug 16, the first plug 14 and the second plug 16 are prevented from passing through the retaining spaces 364. In this way, the connection unit 10 is assembled to the receiving unit 30, and the retaining mechanisms 36 prevent the connection unit 10 from separating from the receiving unit 30.

When the connection unit 10 is not connected to the portable electronic device, the base 32 can be used as a suction cup to be fixed on a planar surface. Thus, the electronic connection device 100 is stably placed, and the data cable 14 tightly coiled on the sleeve barrel 38 is prevented from being tangled or knotted. Furthermore, the main body 34 can be used as a container, such as a vase or a pencil container.

Figure 3:
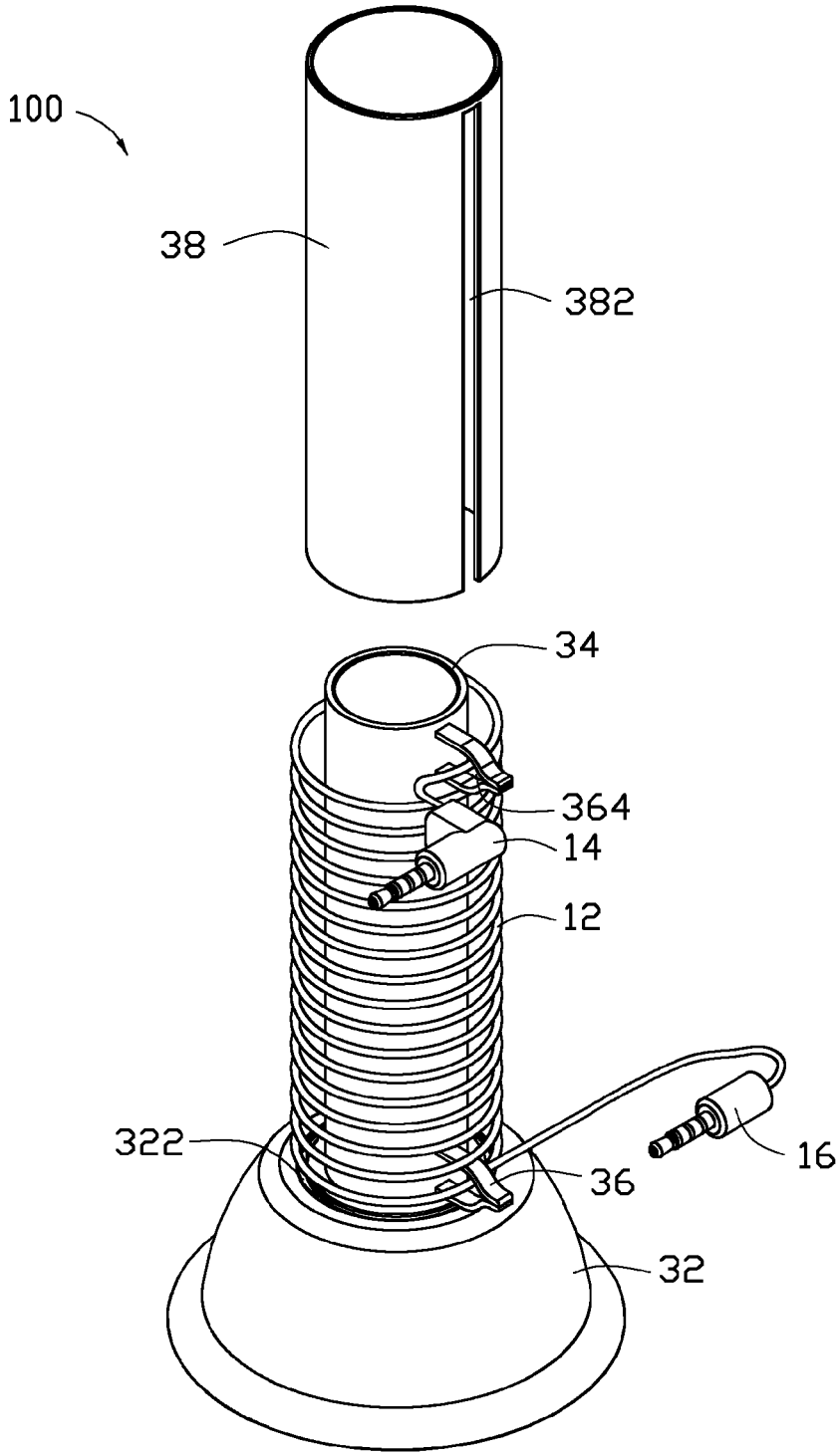
FIG. 3 is an assembled view of the electronic connection device shown in FIG. 1, with a sleeve barrel of the electronic connection device disassembled.
Figure 4:
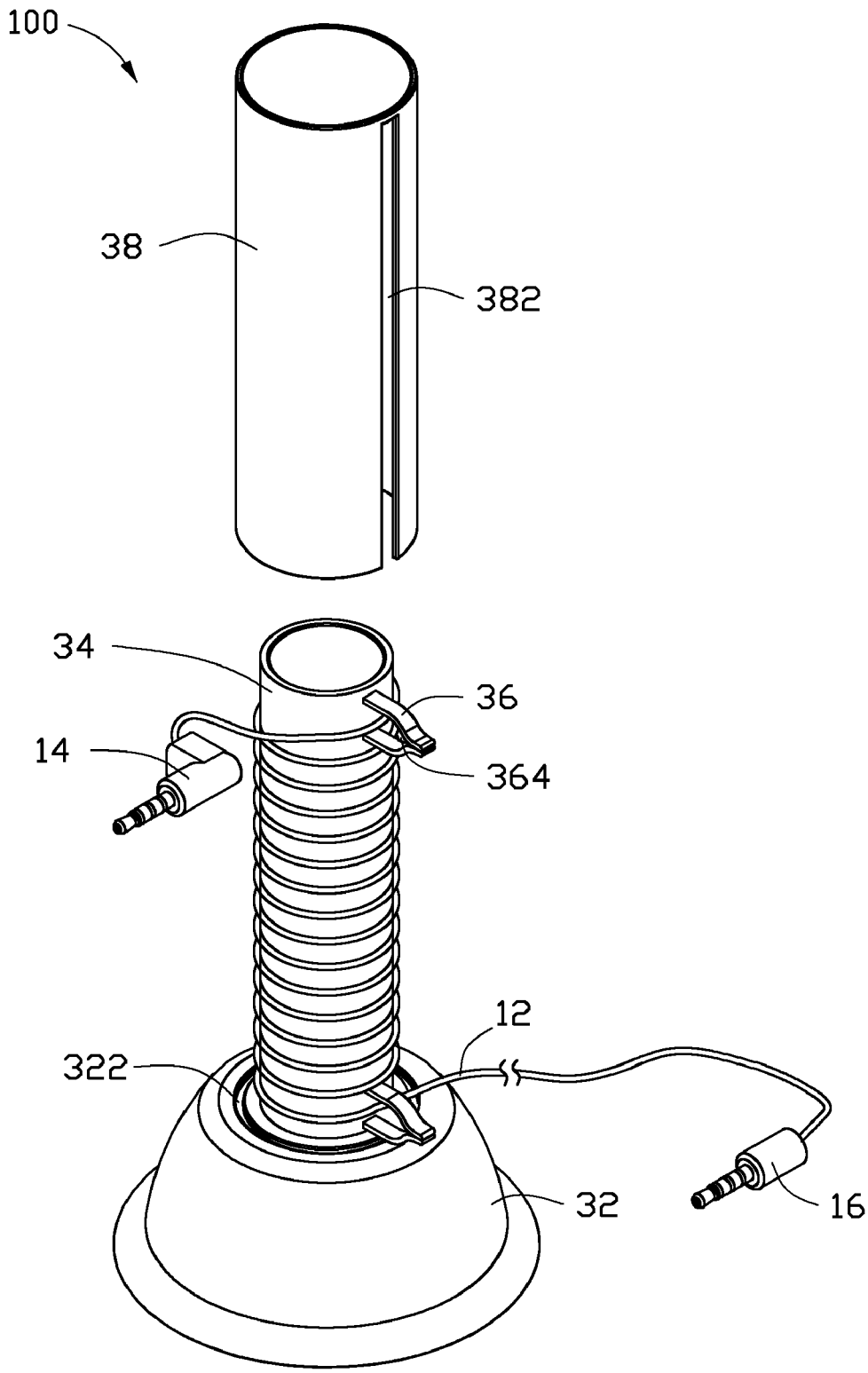
FIG. 4 is a schematic view of using the electronic connection device shown in FIG. 1.

Also referring to FIG. 3 and FIG. 4, when the connection unit 10 is connected to the portable electronic device, the sleeve barrel 38 is moved away from the base 32 to be detached. When the sleeve barrel 38 is removed, space is formed between the data cable 12 and the main body 34. The first plug 14 and the second plug 16 are respectively pulled away from the two retaining mechanisms 36, such that the data cable 12 is tightly coiled about the main body 34. Thus, movements of the first plug 14 and the second plug 16 respectively drive two ends of the data cable 12 to respectively pass through the two retaining mechanisms 36 and extend from the main body 34. Since the outer diameter of the main body 34 is less than the outer diameter of the sleeve barrel 38, the part of the data cable 12 coiled on the main body 34 is shorter than the part of the data cable 12 coiled on the sleeve barrel 38. Thus, the extending parts of the data cable 12 are long enough to be optionally distorted. Therefore, the first plug 14 and the second plug 16 with the extending parts of the data cable 12 connected thereto can be easily connected to the portable electronic device and the audio signal playing device. At the same time, the middle portion of the data cable 12 is still tightly coiled to the main body 34, and is then prevented from entangling with other objects or being knotted.

Figure 5:
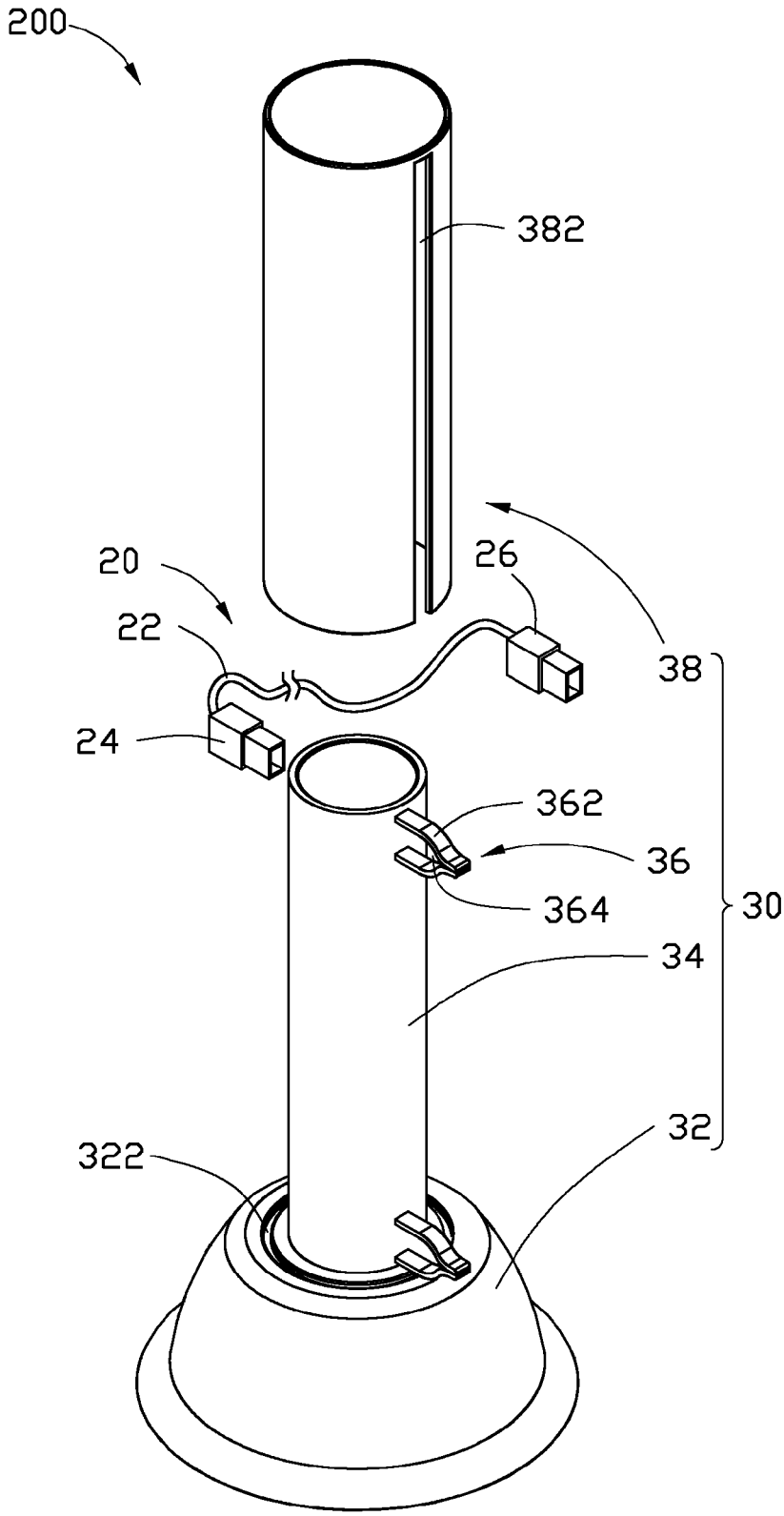
FIG. 5 is a disassembled view of an electronic connection device, according to a second exemplary embodiment.

Referring to FIG. 5, an electronic connection device 200, according to a second exemplary embodiment, is provided. The electronic connection device 200 is substantially similar to the electronic connection device 100, except that a connection unit 20 replaces the connection unit 10. The connection unit 20 may include a data cable 22, a first connector 24, and a second connector 26. The first connector 24 and the second connector 26 may be universal serial bus (USB) connectors of different combinations (micro to mini to standard) and are respectively connected to two ends of the data cable 22. The first connector 24 and the second connector 26 can be respectively connected to USB interfaces of two electronic devices (not shown), and thus the two electronic devices can transmit data to each other by the connection unit 20. Additionally, when some electronic devices, such as personal computers (PC), are connected to other electronic devices by the connection unit 10, they can recharge other electronic devices by the connection unit 10. Method for assembling and using the electronic connection device 200 is similar to above-detailed method for assembling and using the electronic connection device 100. Additionally, the first connector 24 and the second connector 26 can be changed to other kinds of connectors, such as mini-plugs, firewire connectors, etc.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An electronic connection device for electrically connecting two electronic devices to each other, comprising:

a connection unit for electrically connecting the two electronic devices to each other, the connection unit including a data cable; and a receiving unit, the receiving unit including a main body and a sleeve barrel, the sleeve barrel detachably assembled to the main body and receiving the main body therein, the data cable coiled on the sleeve barrel when the sleeve barrel assembled to the main body and coiled on the main body when the sleeve barrel is detached;

wherein the sleeve barrel is a hollow cylinder and defines a receiving groove therein, the receiving groove opening on at least one end of the sleeve barrel; and the receiving unit further includes two retaining mechanisms mounted on the main body, the retaining mechanisms received in the receiving groove when the sleeve barrel receives the main body therein.

2. The electronic connection device as claimed in claim 1, wherein the receiving unit further includes a base connected to the main body, the base being a suction cup for fixing the receiving unit.

3. The electronic connection device as claimed in claim 1, wherein the main body is a hollow cylinder.

4. The electronic connection device as claimed in claim 1, wherein each retaining mechanism includes two elastic retaining members mounted on the main body, the two retaining member bent to contact each other to form a retaining space between the two retaining members.

5. The electronic connection device as claimed in claim 4, wherein the connection unit includes two connectors respectively connected to two ends of the data cable, the two ends of the data cable respectively received in the retaining spaces of the two retaining mechanisms, the two mechanisms respectively prevent the two connectors from passing through their retaining space, thereby preventing the connection unit from separating from the receiving unit.

6. The electronic connection device as claimed in claim 5, wherein the two connectors are audio plugs.

7. The electronic connection device as claimed in claim 5, wherein the two connectors are universal serial bus (USB) connectors.

8. An electronic connection device for electrically connecting two electronic devices to each other, comprising:

a connection unit for electrically connecting the two electronic devices to each other, the connection unit including a data cable; and a receiving unit, the receiving unit including a main body having a less outer diameter and a sleeve barrel having a larger outer diameter, the sleeve barrel detachably assembled to the main body and receiving the main body therein, the data cable coiled on the sleeve barrel; wherein when the sleeve barrel is detached, the data cable is coiled on the main body, and two ends of the data cable extend from the main body due to a part of the data cable coiled on the main body being shorter than a part of the data cable coiled on the sleeve barrel;

wherein the sleeve barrel is a hollow cylinder and defines a receiving groove therein, the receiving groove opening on at least one end of the sleeve barrel; and the receiving unit further includes two retaining mechanisms mounted on the main body, the retaining mechanisms received in the receiving groove when the sleeve barrel receives the main body therein.

9. The electronic connection device as claimed in claim 8, wherein the receiving unit further includes a base connected to the main body, the base being a suction cup for fixing the receiving unit.

10. The electronic connection device as claimed in claim 8, wherein the main body is a hollow cylinder.

11. The electronic connection device as claimed in claim 8, wherein each retaining mechanism includes two elastic retaining members mounted on the main body, the two retaining member bent to contact each other to form a retaining space between the two retaining members.

12. The electronic connection device as claimed in claim 11, wherein the connection unit includes two connectors respectively connected to the two ends of the data cable, the two ends of the data cable respectively received in the retaining spaces of the two retaining mechanisms, the two mechanisms respectively prevent the two connectors from passing through their retaining space, thereby preventing the connection unit from separating from the receiving unit.

* * * * *